US008393653B2

(12) United States Patent
Clark

(10) Patent No.: US 8,393,653 B2
(45) Date of Patent: Mar. 12, 2013

(54) MAGNETIC SAFETY LATCH

(75) Inventor: Anthony John Clark, Cremorne (AU)

(73) Assignee: D & D Group Pty Ltd., Frenchs Forest NSW ( * ) Notice: Subject to any disclaimer, the term of this patent is extended or adjusted under 35 U.S.C. 154(b) by 668 days.

(21) Appl. No.: 12/189,375

(22) Filed: Aug. 11, 2008

(65) Prior Publication Data

US 2010/0033279 A1 Feb. 11, 2010

(51) Int. Cl.
*E05C 17/56* (2006.01)
*E05C 19/16* (2006.01)

(52) U.S. Cl. ..... 292/251.5; 292/137; 292/177

(58) Field of Classification Search ..... 292/251.5, 292/137, 177, 179, 276; 70/276
See application file for complete search history.

(56) References Cited

U.S. PATENT DOCUMENTS

| | | | | |
|---|---|---|---|---|
| 893,072 | A * | 7/1908 | Hayes | 292/174 |
| 1,394,962 | A * | 10/1921 | Bate | 292/167 |
| 2,586,900 | A * | 2/1952 | Alderman | 292/74 |
| 3,334,936 | A * | 8/1967 | Donselaar et al. | 292/251.5 |
| 3,516,701 | A * | 6/1970 | Graham | 292/144 |
| 4,005,886 | A * | 2/1977 | Lirette | 292/177 |
| 4,157,197 | A * | 6/1979 | Wilson | 292/179 |
| 5,362,116 | A * | 11/1994 | Doyle et al. | 292/144 |
| 7,044,511 | B2 * | 5/2006 | Kliefoth et al. | 292/251.5 |
| 7,390,035 | B2 * | 6/2008 | Karcz et al. | 292/163 |
| 2005/0210938 | A1 | 9/2005 | Doyle et al. | |
| 2008/0246286 | A1 * | 10/2008 | Ostrowski | 292/144 |

FOREIGN PATENT DOCUMENTS

| | | |
|---|---|---|
| AU | 649664 | 2/1992 |
| AU | 2005200184 B1 | 4/2005 |

OTHER PUBLICATIONS

International Searching Authority; PCT International Search Report; Sep. 22, 2009.

* cited by examiner

*Primary Examiner* — Carlos Lugo
(74) *Attorney, Agent, or Firm* — Kelly & Kelley, LLP

(57) ABSTRACT

A magnetic latch for a gate has first and second units for mounting on a gate and a gate post respectively. The first unit has a displaceable latch element displaceably mounted in a support in a housing and biased to a retracted position, and a second unit with a complementary engagement structure with which a latching portion of the latch element is adapted to engage when the magnetic latch is in a latching position and the latch element is displaced to a projecting position. A magnetic attracting arrangement is provided to cause the latch element to move to the projecting position and engage in the engagement structure when the magnetic latch is in the latching position, and then the engagement structure prevents movement of the door or gate away from the closed position. A retraction element is provided in the first unit for displacing the support and increasing the bias on the latch element to exceed the force of the magnetic attracting arrangement, whereby the latch element moves towards the retracted position and the gate may be moved from the closed position.

13 Claims, 13 Drawing Sheets

MAGNETIC SAFETY LATCH

The present invention relates to magnetic safety latches and a typical installation is as a safety latch for a gate arranged so that young children cannot reach and operate the latch to pass through the gate, but an older person being able to reach and operate the latch and open the gate. A very important application is to swimming pools where hinged gates must be opened outwardly and the latch mechanism must either be so high that a young child could not reach it and operate it, or must be so mounted that equally a young child could not reach the mechanism to open it.

Similarly, playgrounds for young children may need a gate arranged in the opposite fashion so that a young child could not operate the latch to go out of the playground unsupervised.

The present assignees are the proprietors of Australian Patent No 649,664 and equivalent U.S. Pat. No. 5,362,116 which discloses two models of magnetic safety latch for swimming pool gates. In both cases, an important characterising feature of these latches is that there is no mechanical inter-engagement and in particular no mechanical resistance required when the gate moves to its closed position, for example under the influence of spring hinges. Thus, the prospect of mechanical resistance of mechanical latches preventing the gate reaching the fully closed position and latching occurring is obviated.

For particular applications, new and useful alternatives to known arrangements would provide further consumer choice.

The present invention is directed to providing such consumer choices and may be implemented in embodiments which are economic, convenient to manufacture and install yet are robust, have longevity and provide a high degree of safety.

In one aspect, the present invention provides a magnetic latch for securing a door or gate in a closed position, the latch having a first unit with a displaceable latch element displaceably mounted in a support in a housing and biased to a retracted position, a second unit with a complementary engagement structure with which a latching portion of the latch element is adapted to engage when the magnetic latch is in a latching position and the latch element is displaced to a projecting position, a magnetic attracting arrangement provided in the latch element and the second unit to cause the latch element to move to the projecting position and engage in the engagement structure when the magnetic latch is in the latching position, and then the engagement structure preventing movement of the door or gate away from the closed position, and a retraction element in the first unit for displacing the support and increasing the bias on the latch element to exceed the force of the magnetic attracting arrangement, whereby the latch element moves towards the retracted position and the gate may be moved from the closed position.

The magnet attracting arrangement could be solid or tubular or a combination of solid and tubular portions.

It follows that embodiments made be described as providing for the displaceable latch element to float within quite wide limits.

An important market requirement that is increasing is for the provision of a key locking arrangement for a magnetic latch. The present invention lends itself to such an option as a key actuated lock can be mounted on the first unit or the second unit and can be arranged to lock in position the retraction element and typically the support for the displaceable element; the displaceable element can be slideable within the support under the influence of the spring biasing.

When it is chosen to provide a lock on the first unit, the lock can be mounted on the housing or in the retraction element.

The magnetic attracting arrangement can operate so that freedom of motion exists with the lock actuated into the locked position, yet retraction of the latch element to open the latch is not possible.

Embodiments of the invention can be especially beneficial in being compact and visually attractive, especially when installed in such installations as swimming pools, which frequently now have glass surrounds and glass gates. Such installations need a robust and reliable latch mechanism yet one that can be embodied with appropriate aesthetics.

Another important safety feature, especially with magnetic latches which may be locked, is that when the gate is open the owner may choose to key lock the latch and then remove the key. Embodiments of the present invention lend themselves to safety by virtue of the design ensuring that if locking is effected with the gate open, then irrespective of whether manual intervention causes the displaceable latch element to be projected or retracted, it can still float. Consequently, when released, the displaceable latch element moves under its biasing to a retracted position so that when the gate is released and it reaches the closed position, there will be no impediment to the magnetic forces again establishing latching.

In one embodiment, the first unit has a housing having a base adapted to be secured, for example by screws, to a gate. The retraction element and support may be integrated into a single structure through which the displaceable latch element passes, the latch element being an elongate structure, slideable within the support and the biasing can be in the form of a compression spring acting between an internal shoulder of the support and end portion of the latch element remote from the free end of the latch element which is adapted to engage in latching engagement in the engagement structure of the second unit.

The latch element could be solid, tubular or a combination of solid and tubular portions.

Preferably, the invention is implemented using a magnet mounted within the second unit, the latching element being a metal pin having magnetic properties, e.g. a suitable grade of steel. Alternatively, the magnet may be in the latching element and the second unit can comprise ferromagnetic material.

A further option is for both the second unit and the latching element to have permanent magnets of polarity arranged to attract the parts when in or near the latching position.

An especially important embodiment of the invention is one incorporating a key-operated lock mounted on the facia of the housing of the first unit or mounted in the retraction element and selectively engageable with the support and the associated retraction element whereby the retraction element can be locked against movement yet the latch element remains slideably mounted within the support and subject to its biasing.

For illustrative purposes embodiments of the invention will now be described with reference to the accompanying drawings of which:

FIG. 12 is an isometric view of the magnetic latch arranged in the closed configuration and where locking is established and on an enlarged scale;

FIG. 13 is a front elevation of the magnetic latch of FIG. 12;

FIG. 14 is a sectional inverted plan view along the line A-A of FIG. 13 and showing the latch in the closed and locked position;

FIG. 15 is a front elevation of the latch in the closed but unlocked configuration;

FIG. 16 is a cross-sectional inverted plan view along the line B-B of FIG. 15.

FIG. 17 is a front elevation of the latch when pulled to in the open position.

FIG. 18 is a cross-sectional inverted plan view taken along C-C of FIG. 17.

FIG. 19 is a front elevation of the latch in an open, free and unlocked condition;

FIG. 20 is an inverted plan cross-sectional view taken along D-D of FIG. 19;

FIG. 21 is a front elevation of the latch in an open, free but locked condition;

FIG. 22 is an inverted plan cross-sectional view taken along E-E of FIG. 21.

Figure 1:
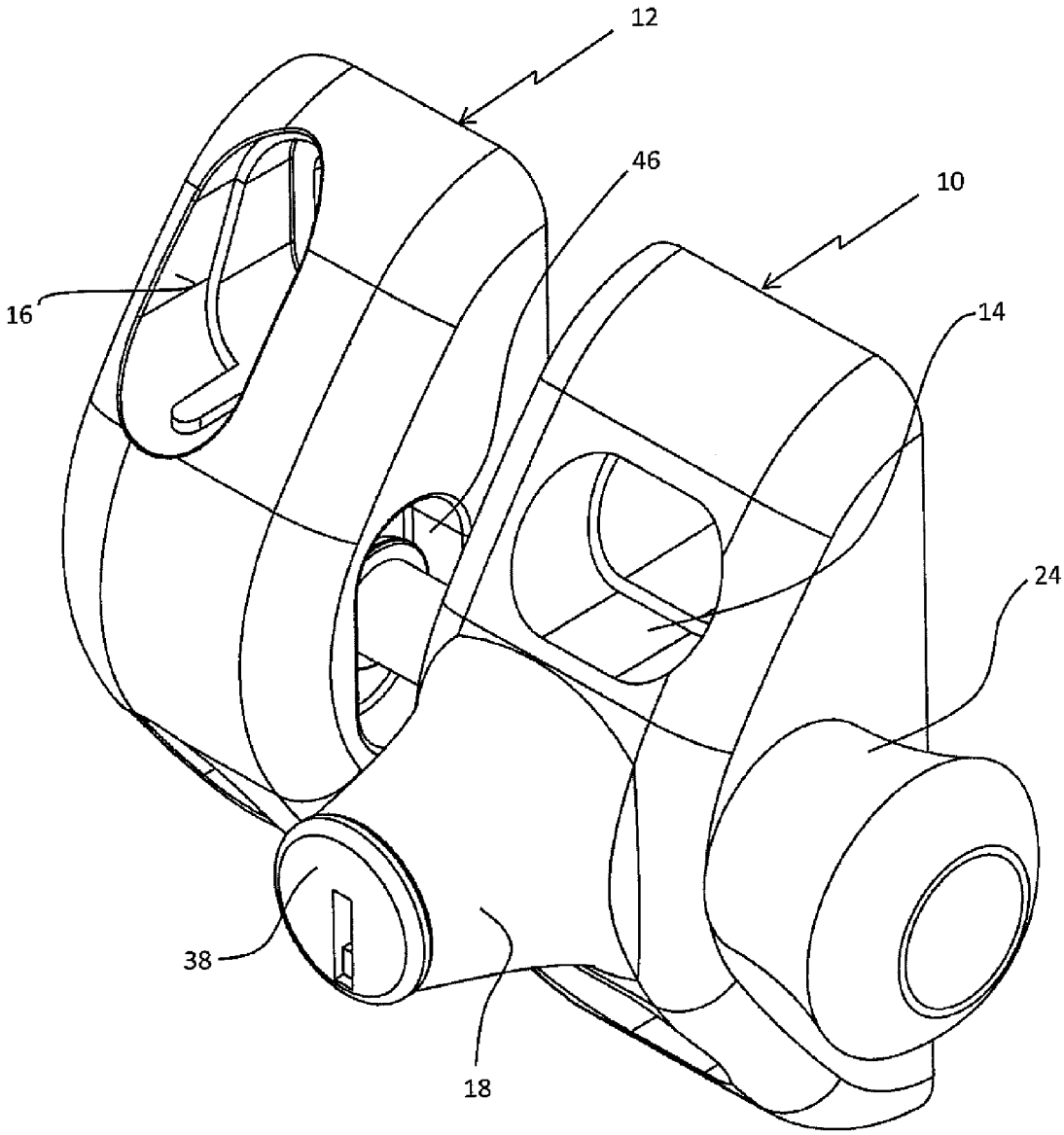
FIG. 1 is a front isometric view of the magnetic latch arranged in the closed configuration and where locking is established and on an enlarged scale.
Figure 2:
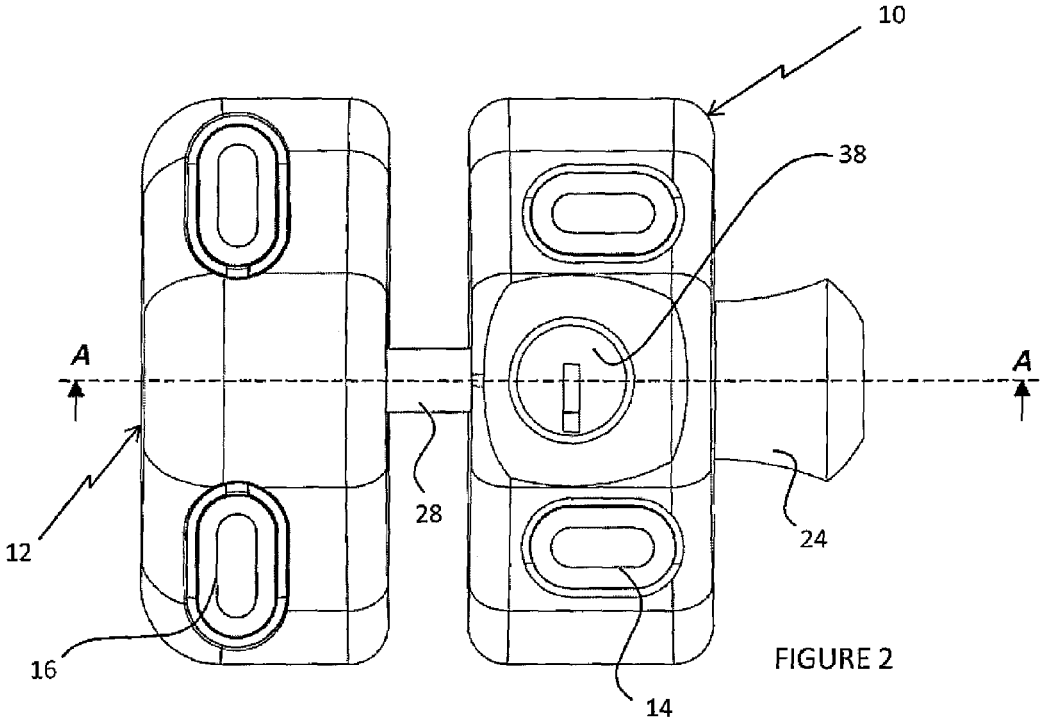
FIG. 2 is a front elevation of the magnetic latch of FIG. 1.

The magnetic latch of the drawings comprises a latching unit 10 and a receiving unit 12 adapted respectively to be mounted on a structure such as a gate and a gate post with suitable fixing screws. FIGS. 1 and 2 show provision for fixing screws to pass through horizontally elongated slots 14 in the latching unit 10 and vertically elongated slots 16 in the receiving unit 12 whereby the units respectively, before final tightening of the screws, can be adjusted for true alignment respectively horizontally and vertically. In use, press-in cover elements will be provided for closing the apertures leading to the slots 14 and 16.

Figure 1A:
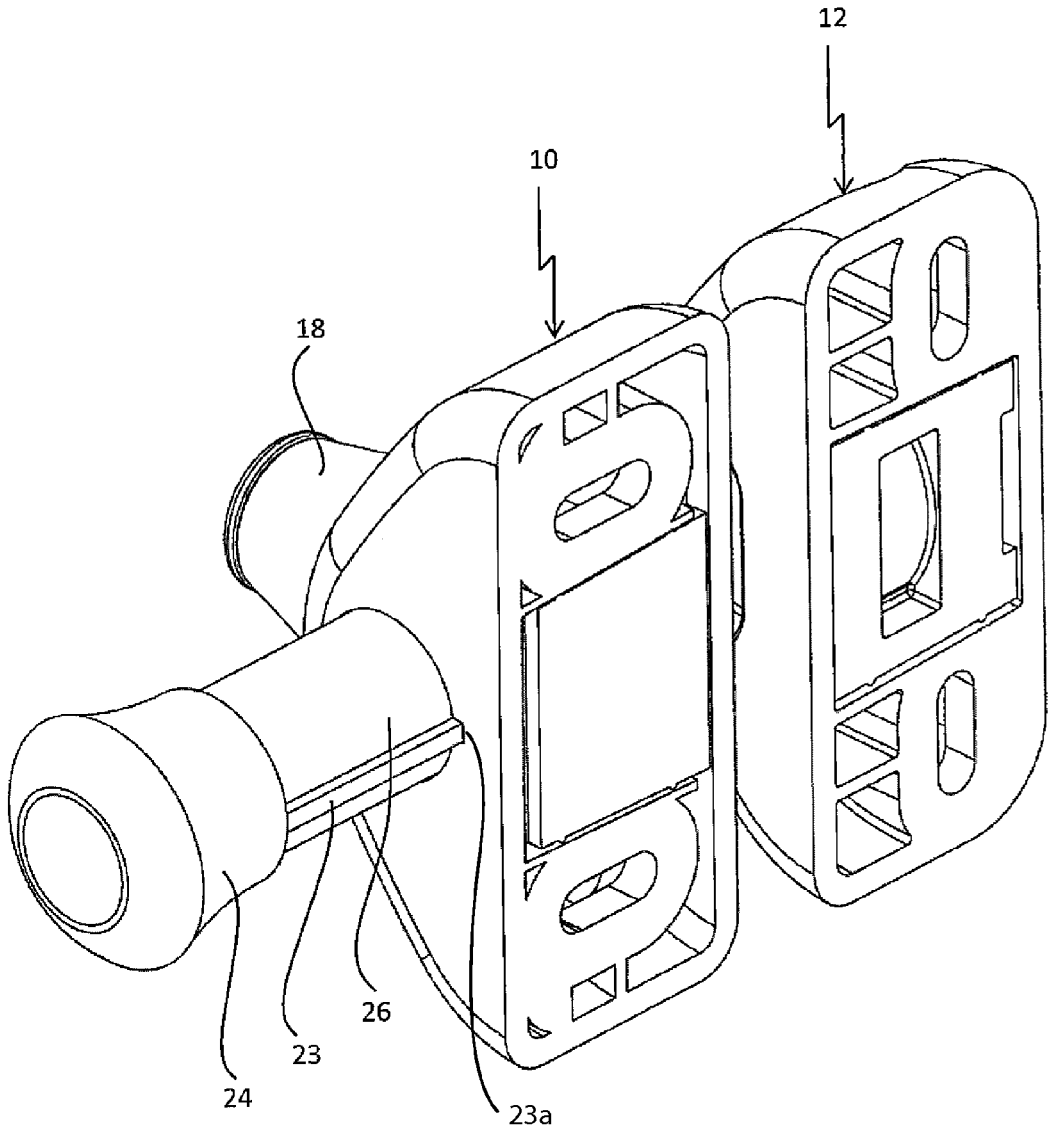
FIG. 1A is a rear isometric view showing the unlocked configuration with the pull-knob pulled on to open the latch.
Figure 3:
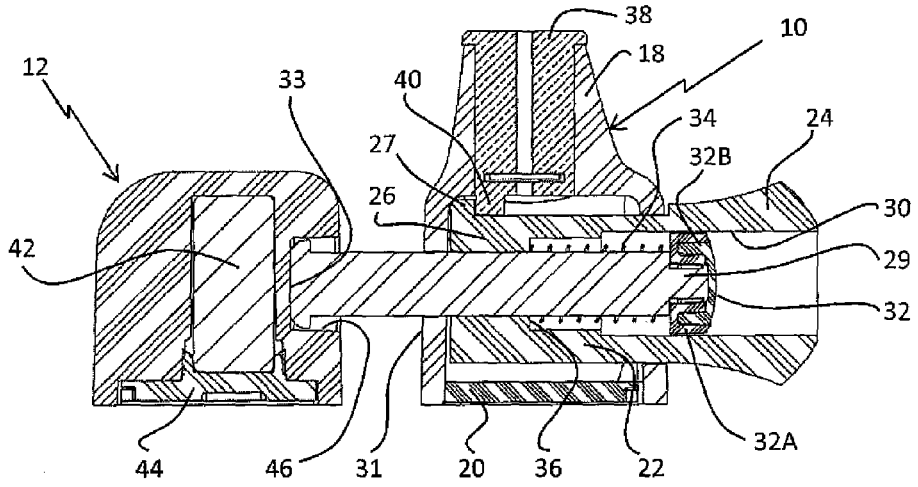
FIG. 3 is a sectional inverted plan view along the line A-A of FIG. 2 and showing the latch in the closed and locked position.

As can most clearly be discerned from FIG. 3, the latching unit 10 comprises a housing 18 with a base plate 20 and displaceably mounting therein, for movement along a horizontal axis, an elongate actuator 22 comprising a retraction element, such as a retraction knob 24, and at the forward end a support barrel 26 in which a latching pin 28 is slidingly mounted for limited independent movement relative to the actuator 22. As best shown in FIG. 1A, on its rear surface the support barrel 26 has an axially extending element, such as an integral spline 23, extending outwardly and guided to a corresponding complementary element or slot 23*a* in, the housing 10 to prevent rotation of the support barrel. Support for the latching pin is provided at the forward support barrel 26 and also within an enlarged bore 30 of the knob in which a cap 32, fitted to the end of the latching pin 28, can slide. A helical compression spring 34 is mounted over the rear end portion of the latching pin 28, the forward end of the spring being seated on a shoulder 36 defining an end of the support barrel 26 and the rear end of the spring being seated on a shoulder of the cap 32.

The housing 18 in its forward middle portion has a sub-housing for accommodating a key-operated lock 38. FIG. 3 shows the lock in the locked condition in which its locking tongue 40 projects to be located behind a shoulder formed on the barrel 26. Thus in the locked position the pressure on the knob 30 to move the actuator to a retracted position is resisted by a lock tongue 40. In the configuration shown in FIG. 3, the latching pin 28 (conveniently of a suitable grade of ferromagnetic steel) is magnetically attracted into latching engagement of the second unit 12 and thus the associated gate cannot be opened. The latch unit 12 comprises a main body portion having a central cavity for accommodating a high coercivity permanent magnet 42 which is located in a weather-sealed cavity by engagement of a back plate 44. As can best be seen from FIG. 1, the housing 12 has an oval shaped latching cavity 46 which permits a degree of vertical misalignment between the enlarged head of the latching pin 28 and the receiving cavity yet latching will still occur. For example, a gate or gate post may drop slightly and this can be accommodated with the design.

In the embodiment at FIG. 3, the cap 32 is fitted to a circular cross-section spigot portion 29 of the latching pin 28 and the cap, of two parts, is fitted firmly to the spigot. The cap 32 has a base portion 32A fitted over the spigot and providing an annular cavity and a curved cap 32B is provided with a projecting lip which fits into the annular cavity to complete the installation.

Regarding the configuration shown in FIG. 3, it will be appreciated that the latching pin 28 is free to float relative to the other components of the latch unit 10. Therefore, if for example due to thermal contraction at night the distance between the first and second unit increases, under the magnetic attraction the latching pin 28 can move relative to the latching unit 10 and the actuator 22 to maintain the head 27 of the latching pin firmly engaged in the cavity 46 and maintain the latching engagement as shown in FIG. 3.

Figure 4:
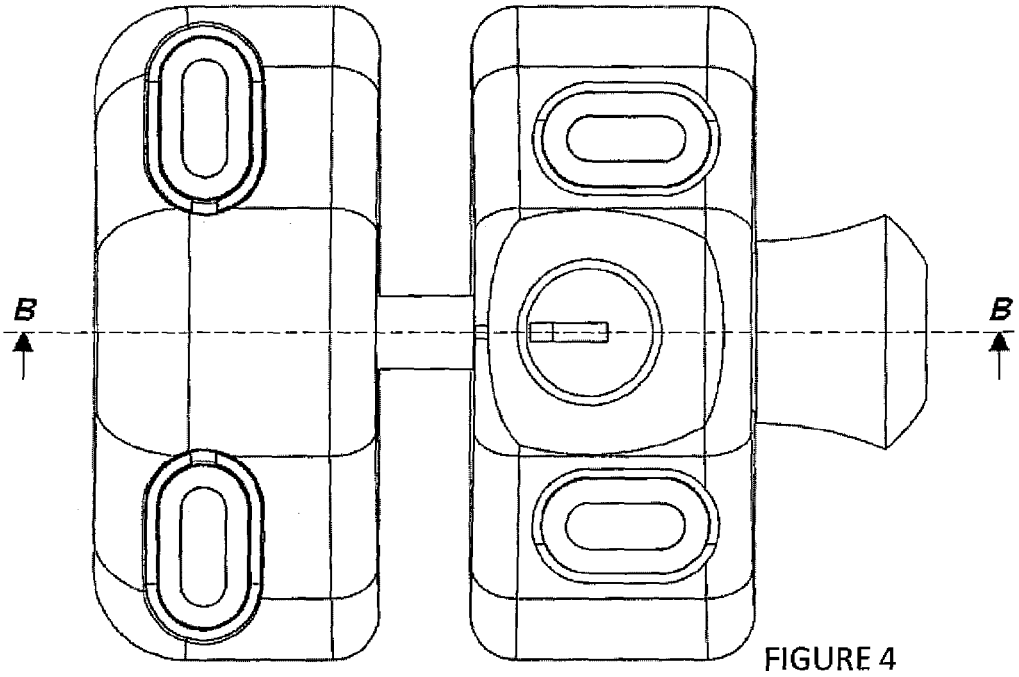
FIG. 4 is a front elevation of the latch in the closed but unlocked configuration.
Figure 5:
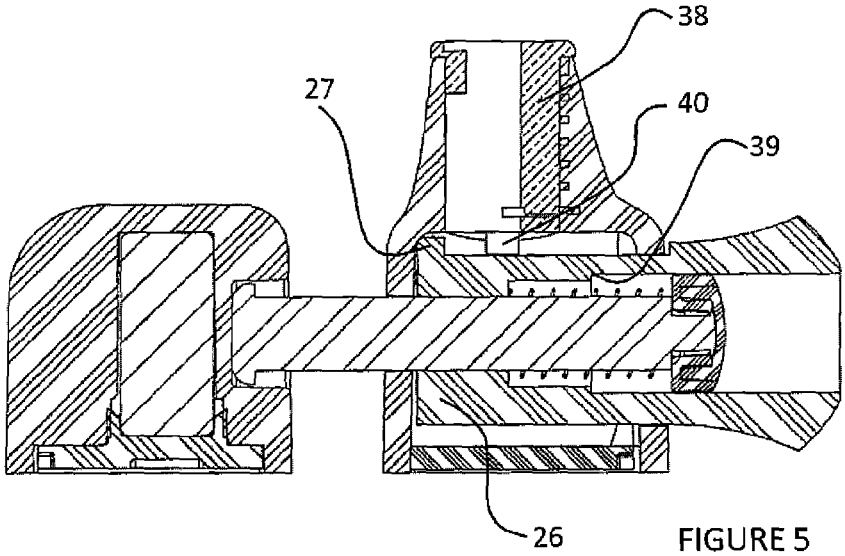
FIG. 5 is a cross-sectional inverted plan view along the line B-B of FIG. 4.

Whereas FIGS. 2 and 3 show a closed and locked configuration, FIGS. 4 and 5 shows the configuration when the lock is unlocked and the latch is closed. When the lock 38 is unlocked, tongue 40 is rotated to be displaced away from an annular shoulder 27 of the support barrel 26. The knob 24 can then be pulled to the right to the configuration shown in FIGS. 6 and 7. This action causes the spring 34 to a fully compressed and an enlarged tip 32 of the latching pin 28 abuts the end face 31 of the housing 18. During retraction, the support barrel 26 of the actuator 22 has been slidingly supported on an aperture defined in the right hand side wall of the housing 18 and is further supported by engagement around the periphery of the latching pin 28 while the opposite end of the latching pin 28 has been slidingly supported in a corresponding aperture in the left hand side wall of the housing nearer the second unit. It will be appreciated that the initial movement of the actuator 22 to the right (as shown in the drawing) initially increases the load on and compression of the helical spring 34 until the force applied to the latching pin 28 exceeds the magnetic attraction occurring in the position shown in FIG. 3. However, an interior shoulder 39 in the mid-portion of the actuator 22 will ultimately engage the interior of the cap 32A to displace the latching pin 28 to the retracted position of FIG. 7.

Figure 8:
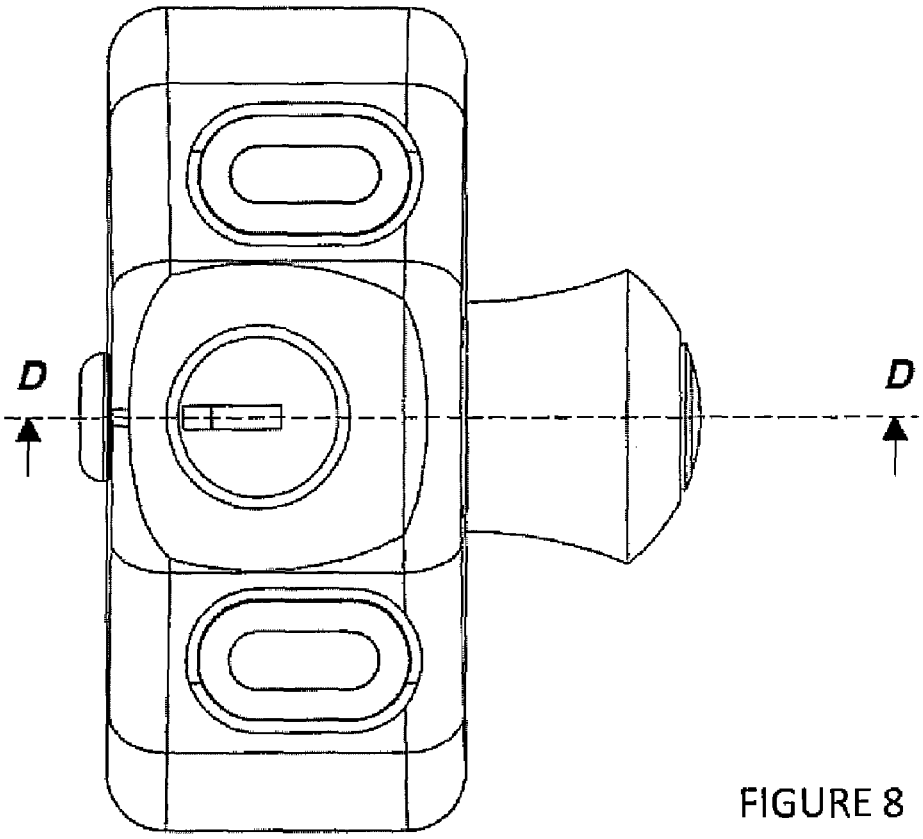
FIG. 8 is a front elevation of the latch in an open, free and unlocked condition.
Figure 9:
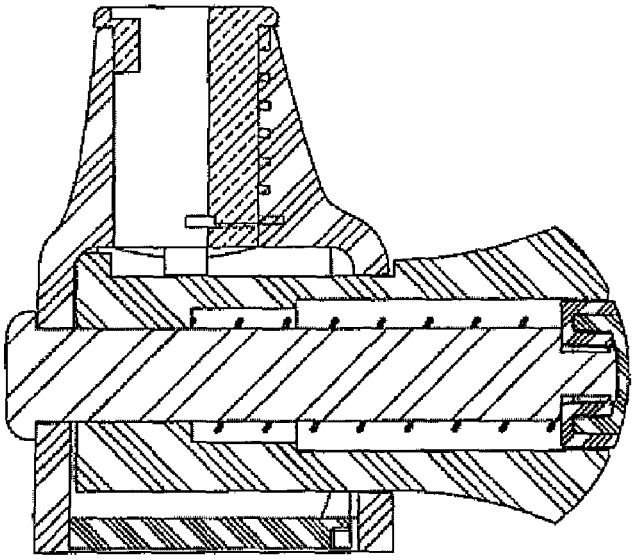
FIG. 9 is an inverted plan cross-sectional view taken along D-D of FIG. 8.

Referring now to FIGS. 8 and 9, the position is shown when a gate has been opened and the latch unit 10 is remote from the magnetic unit 12 and the knob 24 released. The lock is not locked. The knob 24 has been released so it re-establishes the same position in the housing as in FIG. 3. The helical spring, however, extends to urge the latching pin 28 to its fully retracted position as shown. Therefore, if the gate is released and closes, for example under the action of spring hinges, when the latching unit 10 is in juxtaposition with the magnetic unit 12 for latching, the latching pin 28 is free to be attracted under magnetic influence to the configuration shown in FIG. 3 with the compression spring partly compressed and thus magnetic latching will occur with the lock in the unlocked configuration.

Figure 10:
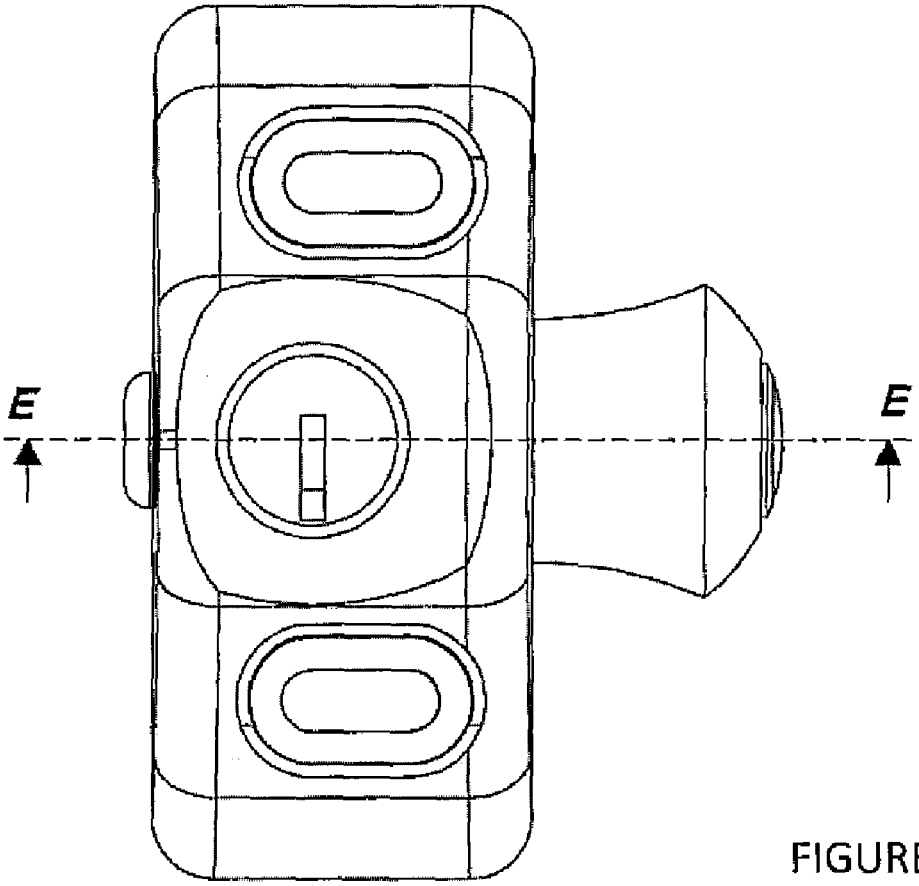
FIG. 10 is a front elevation of the latch in an open, free but locked condition.
Figure 11:
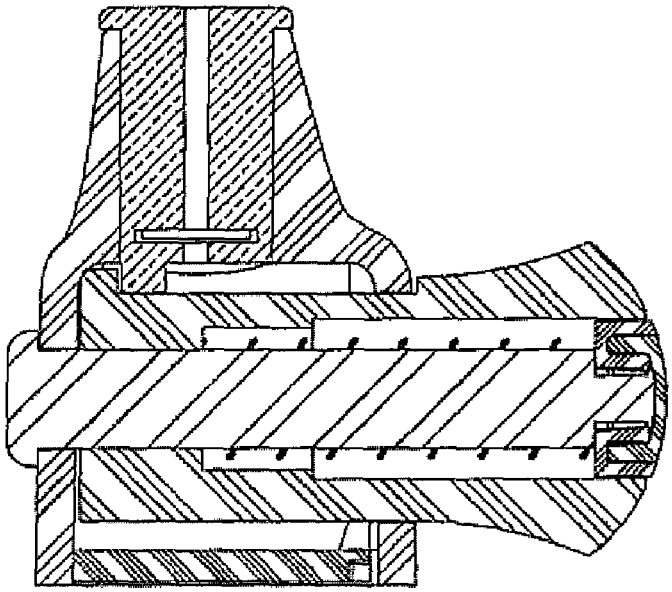
FIG. 11 is an inverted plan cross-sectional view taken along E-E of FIG. 10.

FIGS. 10 and 11, however, show the configuration when the latch (and gate) are in the open position and the lock is locked, yet the latching pin is free. Therefore when the gate is released and moves to a latching position, the latching pin is free to move to the position shown in FIGS. 2 and 3.

Figure 6:
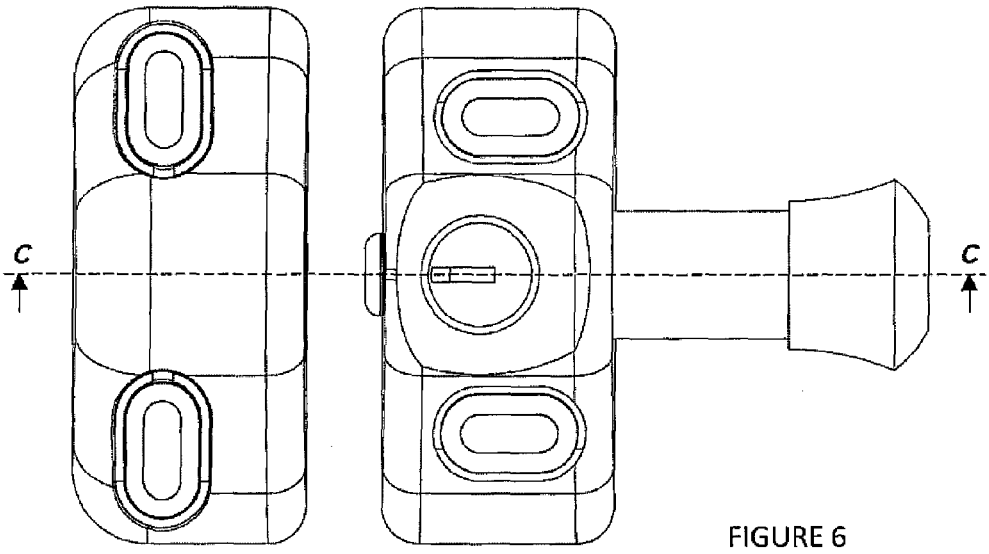
FIG. 6 is a front elevation of the latch when pulled to in the open position.
Figure 7:
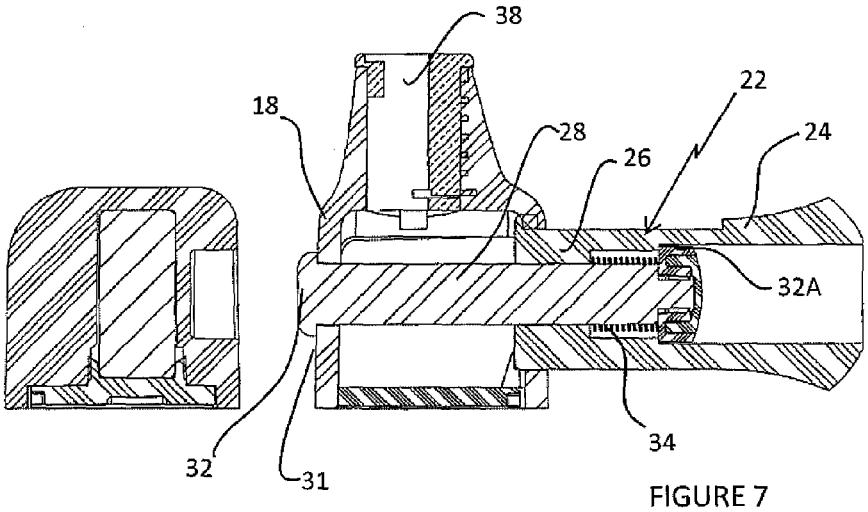
FIG. 7 is a cross-sectional inverted plan view taken along C-C of FIG. 6.

In the event the user perversely seeks to lock the lock when the latching unit is in the configuration shown in FIGS. 6 and 7, when the actuator 22 is released it moves towards the position of FIGS. 2 and 3 but cannot fully move to that position because of interference of the leading shoulder 27 with the tongue 40 of the lock 38. Thus, the actuator 22 is a little to the right of the configuration shown in FIG. 3 yet, when a gate is closed, safety occurs because the latching pin 28 is free to move under the influence of the magnetic force to achieve latching. The latching unit is not locked but has safely achieved magnetic latching.

Figure 12:
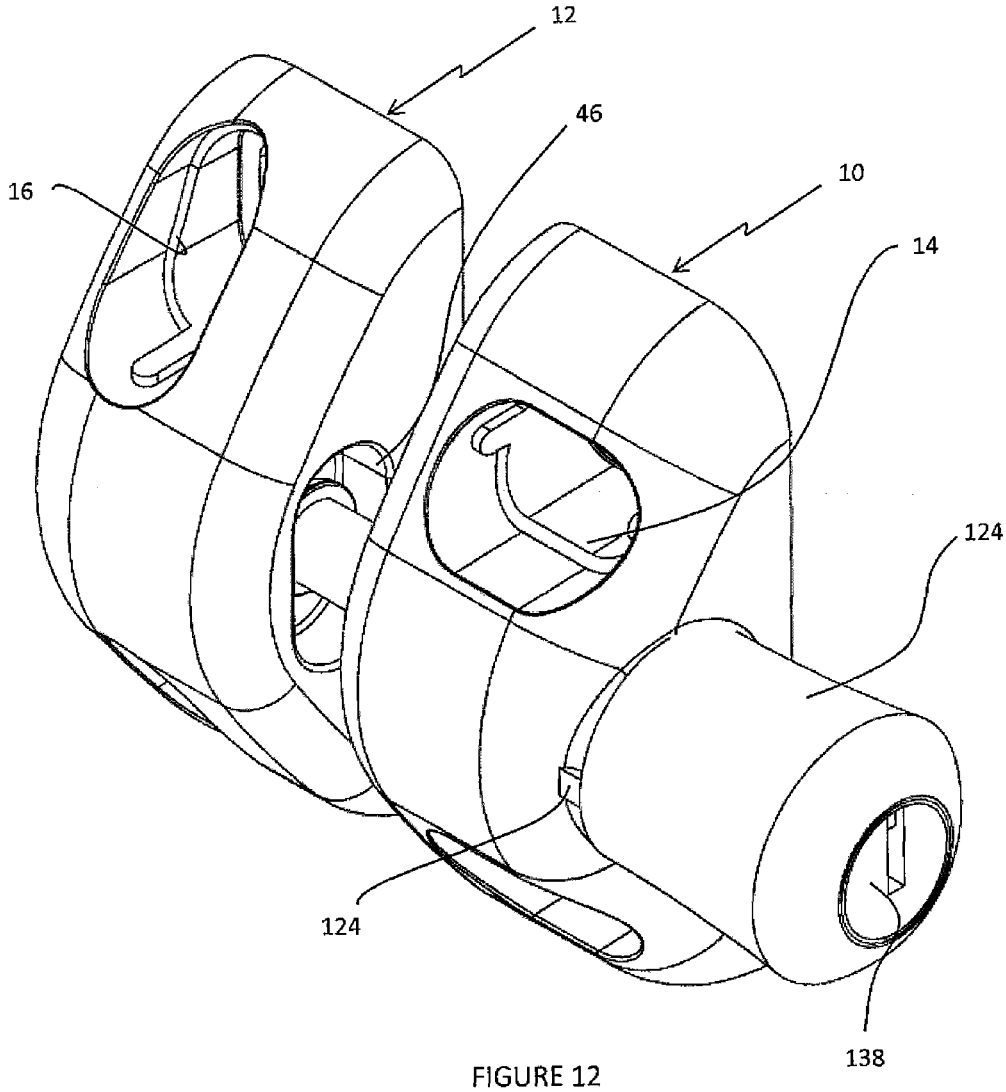
FIGS. 12-22 are of a second embodiment, the Figures corresponding to FIGS. 1-11. Thus
Figure 13:
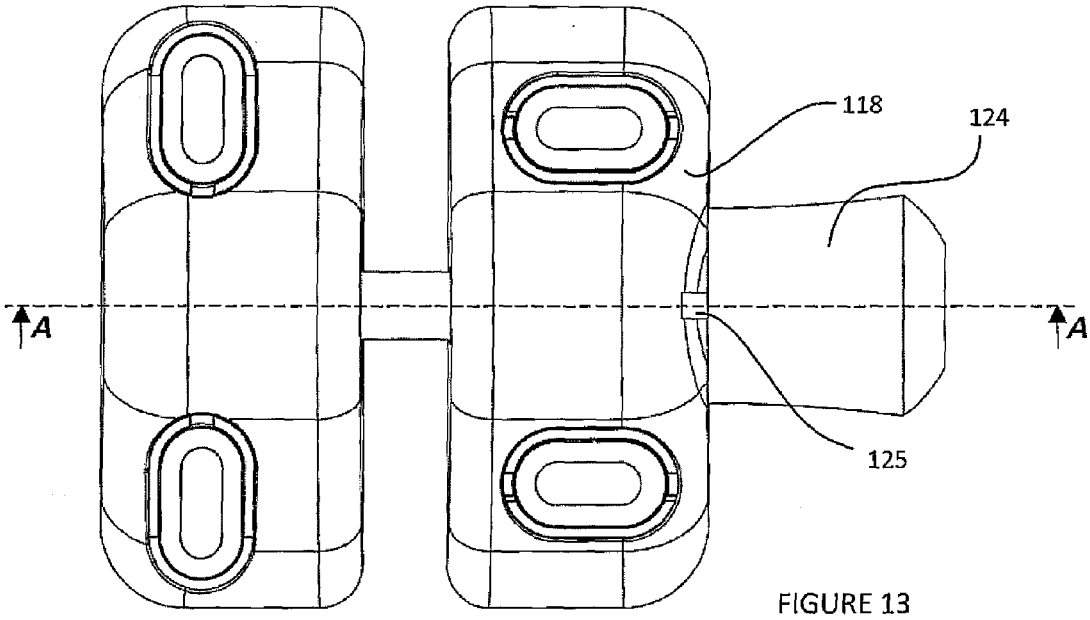

Referring now to the second embodiment of FIGS. 12-22, like parts have been given like reference numerals and where a component is equivalent, the reference numeral is 100 greater; for example the lock 38 of FIG. 1 becomes lock 138 in FIG. 12.

Figure 14:
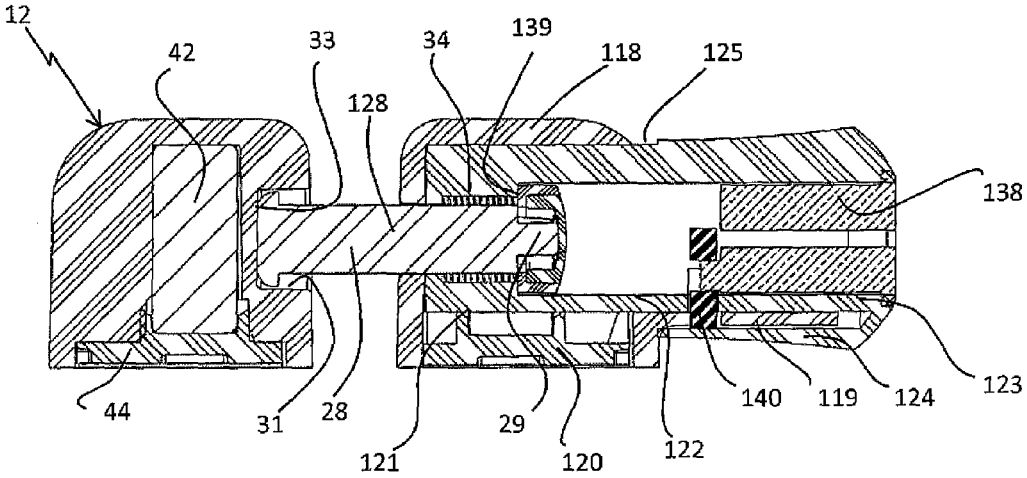
Figure 15:
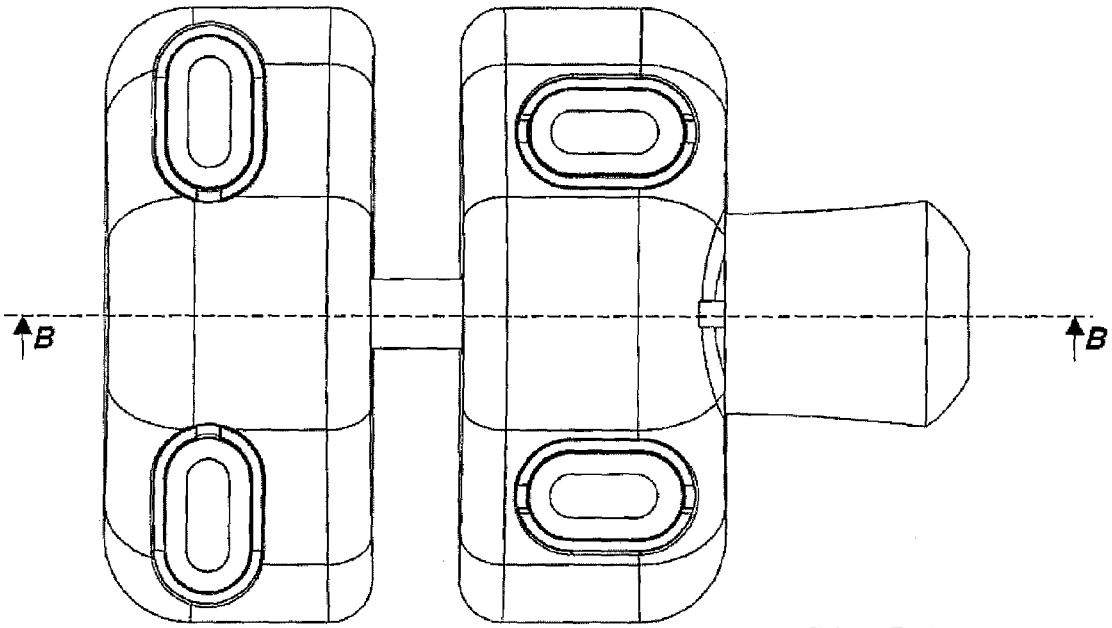

The primary difference in the second embodiment is that the lock 138 is axially engaged within the end portion of the actuating knob 124 rather than being mounted in the housing and extending transversely of the product. To achieve this, the detailed form of the housing 118 and the internal structure differs in detail as will now be described particularly with reference to FIG. 14 showing the product when the latch is closed and the lock has been engaged. Thus the latching pin 28 is magnetically attracted towards the high coercivity magnet 42 in the second unit 12 but the latching pin is shorter than the first embodiment yet its right hand end is identical with a closure cap 32 mounted to the spigot portion 29 of the pin, with the helical compression spring 34 located between, at the left hand end, the inner end wall of a tubular actuator 122 and at the right hand end the inner end wall of the cap 32. Unlike the first embodiment, when the spring 34 is partially extended in the closed and locked position of FIG. 3, in this case the compression spring 34 is substantially compressed. It will be noted that the peripheral portion of the shoulder of the cap 32 engages against a shoulder 139 in the intermediate portion of the actuator, the shoulder most clearly being seen in for example FIG. 20.

The actuator 122 is a slideable barrel supported within the housing 118 at its forward end particularly by support legs 121 extending inwardly from the closure plate 120 on the rear face. The actuator 122 is further supported at its right hand end by being a sliding fit within a tubular extension 119 of the housing which extends into an annular cavity defined between the outer wall of a cylindrical extension 123 and the profiled knob 124 which is adapted to be manually gripped for displacement purposes. The actuator 122 has a integrally formed spline 125 extending from its forward mid-position for engaging in a complementing slot in the housing 10 to prevent rotation of the actuator 122. The lock 138 is secured conventionally within the cylindrical extension 123. The lock 138 has a lock tongue 140 which, by comparing FIGS. 14 and 16, can be seen to be such that the tongue when moved to the locking position moves laterally through an aperture 125 in the side wall of the cylindrical extension 123 and an aligned aperture 127 in the adjacent extension 119 of the housing.

Thus in the configuration of FIG. 14 the lock tongue 140 projects through the actuator 122 and housing extension 119 thereby preventing manual displacement of the actuating knob 124. However, the latching pin 128 is free to float so that the close juxtaposition of the tip 33 of the latching pin towards the magnet is maintained despite thermal expansion or contraction or other movement of the gate and gate post which the product is fitted.

Figure 16:
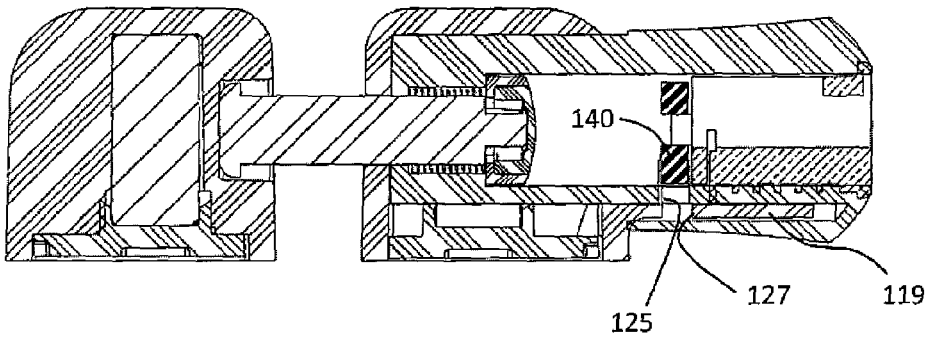
Figure 17:
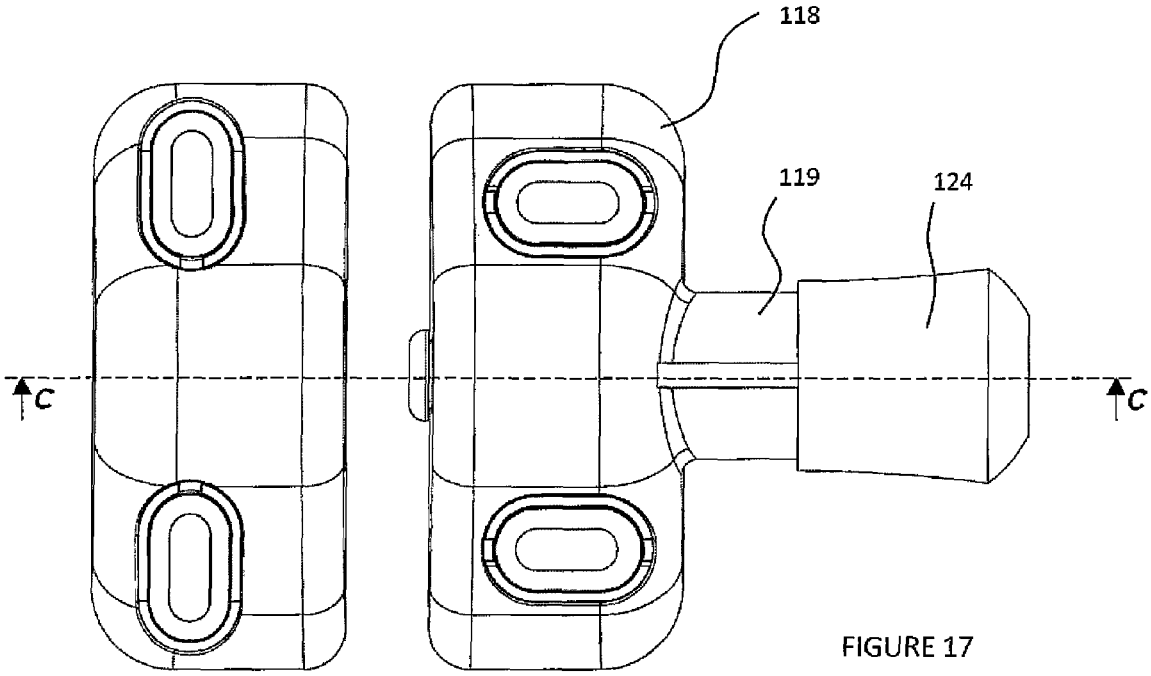
Figure 18:
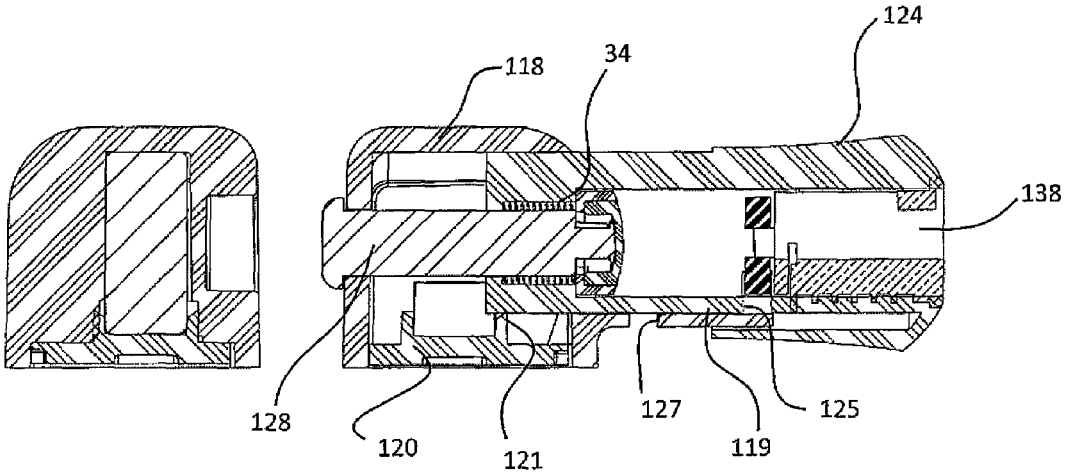
Figure 19:
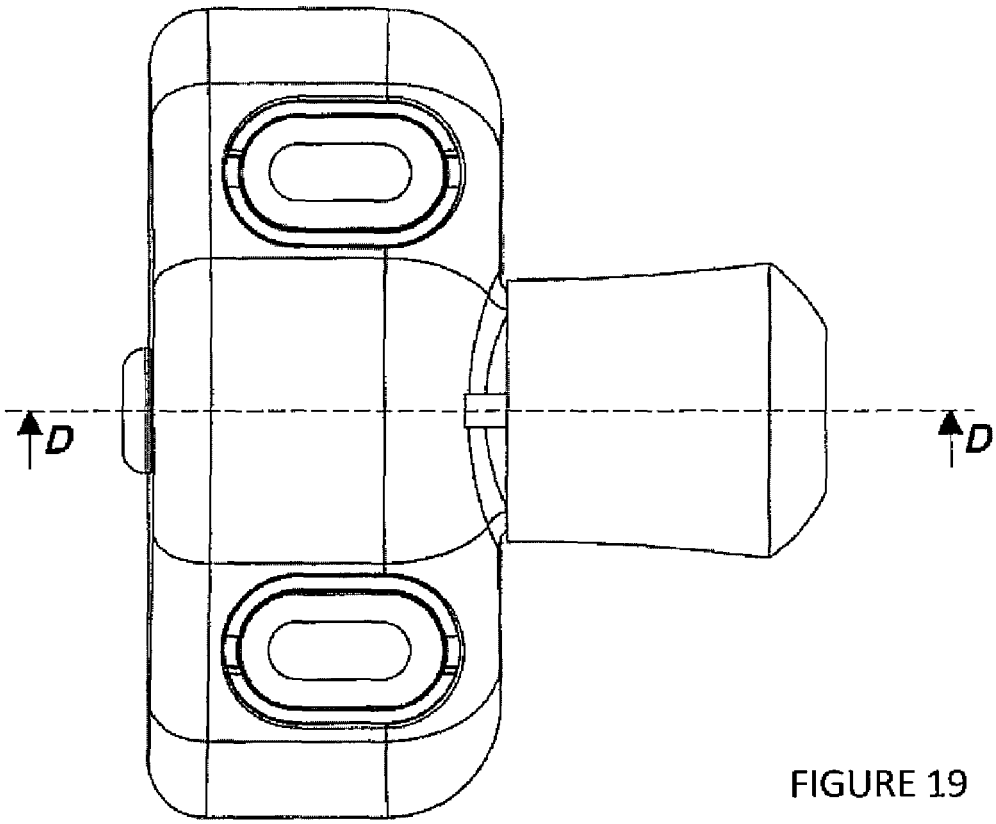

When the lock is unlocked as shown in FIG. 16, then manual pressure may be applied to the knob 124 to displace the actuator and interconnected latching pin to the right relative to the housing to adopt the position shown in FIG. 18.

Figure 20:
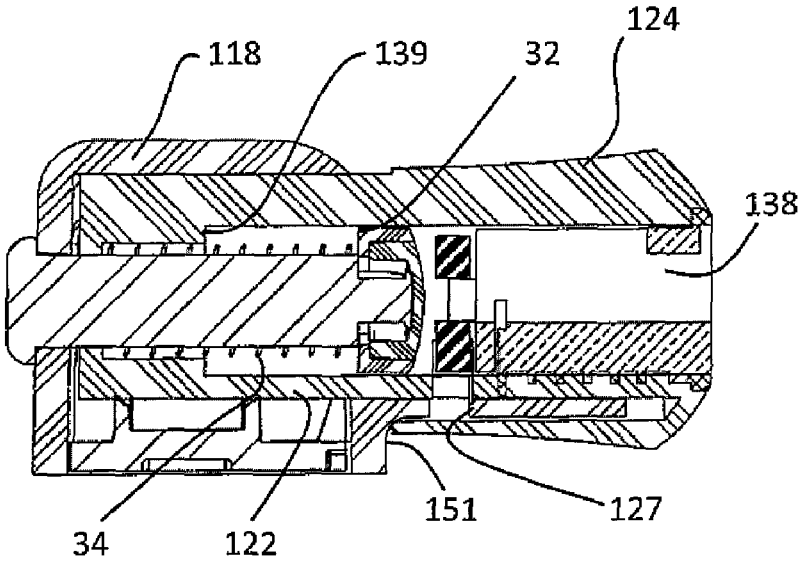
Figure 21:
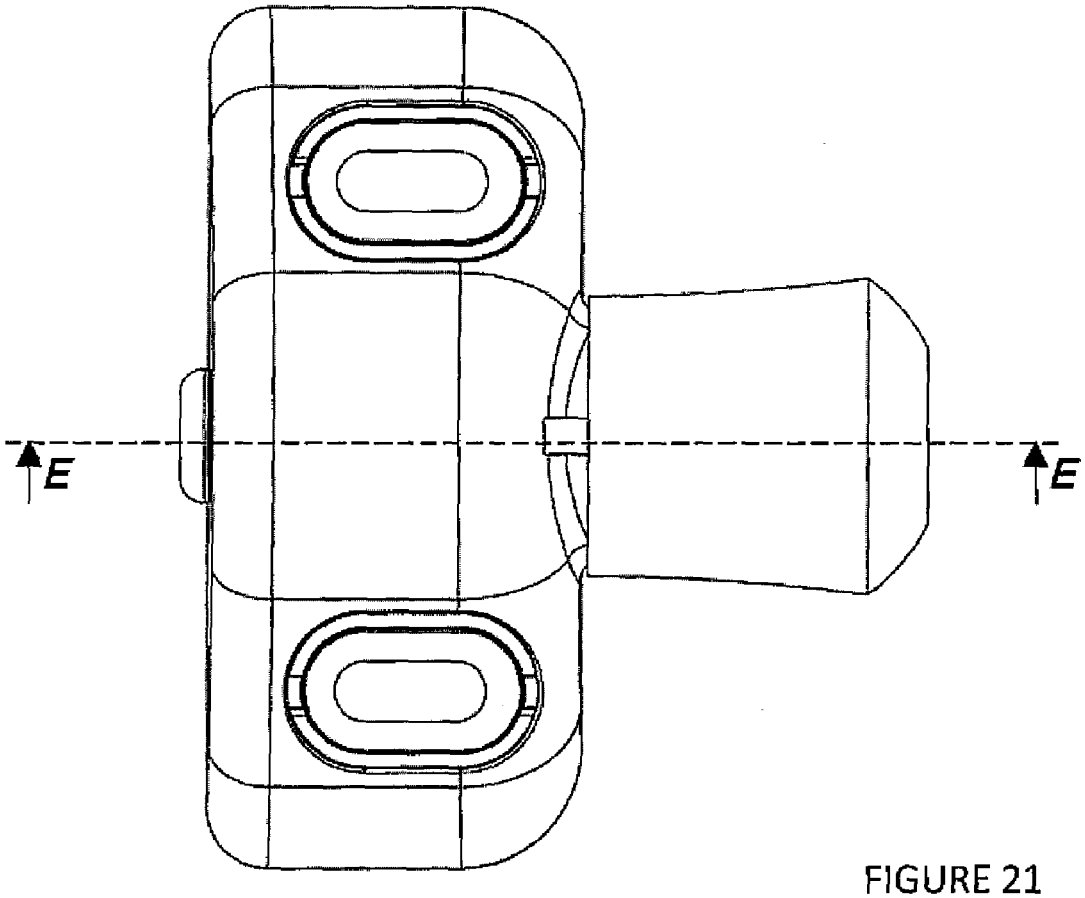

When the associated gate has been opened and the knob 124 released, but the lock is retained in unlocked condition, then the configuration of FIG. 20 is achieved. A leading end shoulder of the knob comes into abutment with a corresponding shoulder 151 on the rear of the housing 118. In this configuration the spring 34 is substantially extended and urges the end cap 32 away from the shoulder 139 within the actuator 122. Consequently if the gate is released and moved to a closed position then when the latching pin 128 comes into appropriate juxtaposition with the second unit 12, then the configuration shown in FIG. 14 is readopted and the spring 34 substantially compressed due to the magnetic attraction forces.

Figure 22:
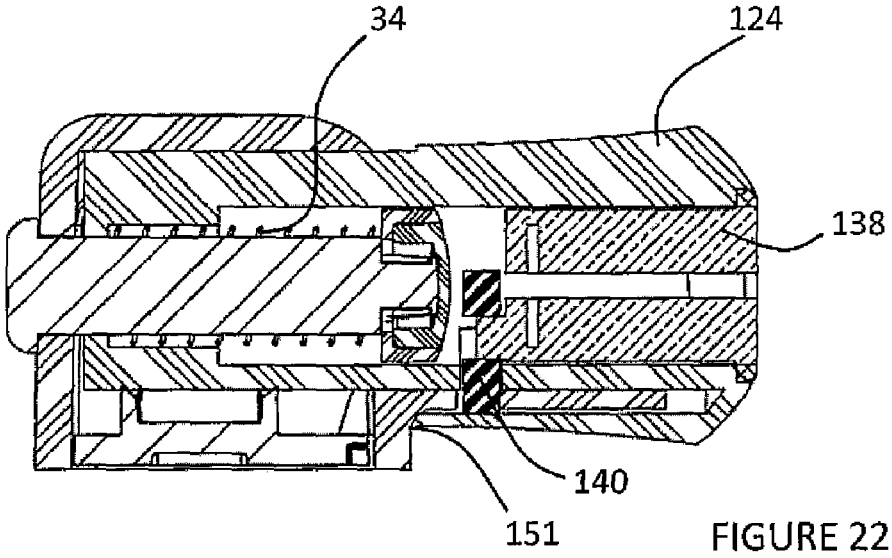

In the event that in the open and free position the lock 138 is locked, then the configuration of FIG. 22 arises. The tongue 140 is projected through the aligned apertures 125 and 127 to lock the knob 124 relative to the housing 118 so that if the gate is released and moves to the latching position, the latching pin 128 is free to be a magnetically attracted into the position shown in FIG. 16 with compression of the spring arising. Thus automatically there is safely established the locked arrangement of FIG. 14.

The invention claimed is:

1. A magnetic latch for securing a moveable barrier in a closed position, the latch comprising:

a first unit with a displaceable latch element displaceably mounted in a support in a housing and biased by a biasing member to a retracted position;

a second unit with a complementary engagement structure with which a latching portion of the latch element is adapted to engage when the magnetic latch is in a latching position and the latch element is displaced to a projecting position;

one of the latch element and the second unit comprising a magnet, and the other one of the latch element and the second unit having magnetic properties, to cause the latch element to move to the projecting position and engage in the engagement structure when the magnetic latch is in the latching position, and then the engagement structure preventing movement of the barrier away from the closed position;

a retraction element coupled to the support in the first unit, wherein the retraction element is moveable from an inward position to an outward position displacing the support causing movement of the latch element towards the retracted position and increasing the bias exerted by the biasing member, the biasing member also being arranged to a bias to the retraction element;

wherein when the latch element is in the retracted position and the retraction element is in the outward position, the biasing member is operative to move the retraction element under the bias of the biasing member into the inward position while biasing the latch element in the retracted position; and after the latch element is in the retracted position the barrier may be moved from the closed position.

2. A magnetic latch as claimed in claim 1, wherein the first unit is arranged to be mounted with the latch element slideably mounted for movement along a substantially horizontal axis within the support which itself is slideably mounted for substantially horizontal movement relative to the housing and relative to the latch element.

3. A magnetic latch as claimed in claim 1, wherein the latch element comprises a metal pin of material which is attracted to the magnet and the second unit contains a permanent magnet sealed within the second unit and adjacent to a cavity providing the complementary engagement structure.

4. A magnetic latch as claimed in claim 1, wherein the latch element comprises a permanent magnet and the second unit has ferromagnetic material to be attracted to the latch element or has a permanent magnet with suitable polarity to be attracted to the latch element.

5. A magnetic latch as claimed in claim 1, wherein the support is in the form of an elongate barrel slideable relative to the latch element which itself is elongate and the support being slideable through a support aperture in the housing.

6. The magnetic latch as claimed in claim 1, further having a key-actuated lock mounted on the first unit and when locked, adapted to inter-engage with the support to prevent retraction of the support and releasable to allow the support to be displaced away from the second unit to compress the spring of the first unit and/or have an interior shoulder of the support engage with an enlarged end portion of the latch element to move the latch element in an unlatching retracted direction.

7. The magnetic latch as claimed in claim 6, wherein the structure of the support and the retraction element of the first unit is such that if the lock is locked with the retraction element fully outward or with the retraction element inward, in either case the latch element is free to re-engage in magnetic latching with the second unit when the first unit and second unit are brought together.

8. The magnetic latch as claimed in claim 6, wherein the housing has a mounting for the lock which has an axis transverse to the latching elements axis.

9. The magnetic latch as claimed in claim 6, wherein the lock is mounted in the retraction element and has an axis along the axis of the latching element.

10. The magnetic latch as claimed in claim 1, wherein the retraction element has an elongate element extending in the direction of a central axis and the housing has a complementary element adapted to co-operate with the elongate element to prevent rotation of the retraction element about its axis.

11. The magnetic latch as claimed in claim 6, wherein the latch element is cylindrical and co-axially mounted within the support which at end provides a bore in which the latch element is a sliding fit and at the other end has a counter bore in which an enlarged end portion of the latch element is a sliding fit, an annular space between the counter bore and the latch element accommodating a helical compression spring biasing the latch element towards a retracted position.

12. The magnetic latch as claimed in claim 11, wherein an end portion of the counter bore remote from the bore mounts a lock operable to prevent relative movement axially of the support relative to the housing yet leaving the latch element to be axially movable under forces of magnetic and spring biasing.

13. A magnetic latch for securing a moveable barrier in a closed position the latch comprising:

a first unit with a displaceable latch element displaceably mounted in a support in a housing and biased by a biasing member to a retracted position;

a second unit with a complementary engagement structure with which a latching portion of the latch element is adapted to engage when the magnetic latch is in a latching position and the latch element is displaced to a projecting position;

one of the latch element and the second unit comprising a magnet, and the other one of the latch element and the second unit having magnetic properties, to cause the latch element to move to the projecting position and engage in the engagement structure when the magnetic latch is in the latching position, and then the engagement structure preventing movement of the barrier away from the closed position;

a retraction element coupled to the support in the first unit, wherein the retraction element is moveable from an inward position to an outward position displacing the support causing movement of the latch element towards the retracted position and increasing the bias exerted by the biasing member;

wherein when the latch element is in the retracted position and the retraction element is in the outward position, the biasing member is operative to move the retraction element into the inward position while biasing the latch element in the retracted position; and after the latch element is in the retracted position the barrier may be moved from the closed position;

wherein the support is in the form of an elongate barrel slideable relative to the latch element which itself is elongate and the support being slideable through a support aperture in the housing;

wherein the barrel has an interior cavity accommodating in sliding relationship an end portion of the latch element and biasing is by helical compression spring between an inwardly directed face of the end portion of the latch unit and an end wall of the cavity.

* * * * *